United States Patent [19]

Rango

[11] Patent Number: 4,892,314

[45] Date of Patent: Jan. 9, 1990

[54] GOLF PUTTER WITH DETACHABLE DIVOT MENDER STORED IN GRIP

[76] Inventor: Joseph F. Rango, 39770 St. Michel Pl., Palm Desert, Calif. 92260

[21] Appl. No.: 298,125

[22] Filed: Jan. 17, 1989

Related U.S. Application Data

[63] Continuation-in-part of Ser. No. 111,864, Oct. 23, 1987, Pat. No. 4,799,684.

[51] Int. Cl.[4] ..... A63B 53/00

[52] U.S. Cl. ..... 273/162 D; 273/162 F

[58] Field of Search ..... 273/162 R, 162 A, 162 B, 273/162 C, 162 D, 162 E, 162 F, 32 B

[56] References Cited

U.S. PATENT DOCUMENTS 3,833,223 9/1974 Shulkin ..... 273/162 R 4,799,684 1/1989 Rango ..... 273/162 F

*Primary Examiner*—George J. Marlo

*Attorney, Agent, or Firm*—I. Louis Wolk

[57] ABSTRACT

A golf putter including a hollow shaft having a hand grip and a cap which surrounds the upper end of the shaft and a divot mending device positioned within such hollow end.

The original cap over the end of the shaft is provided within an opening through which the body of the mending device is inserted, said opening and said body are dimensioned so that the device is engaged by the wall of said opening and depends therefrom. The device is provided with a cap portion which overlies the original cap and which may be formed with a recess to receive a ball marker.

2 Claims, 1 Drawing Sheet

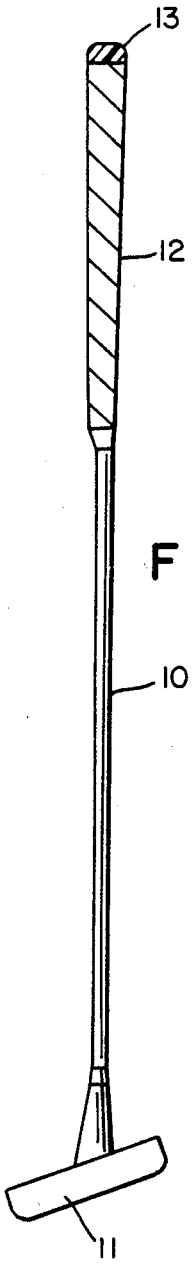
FIG. 1
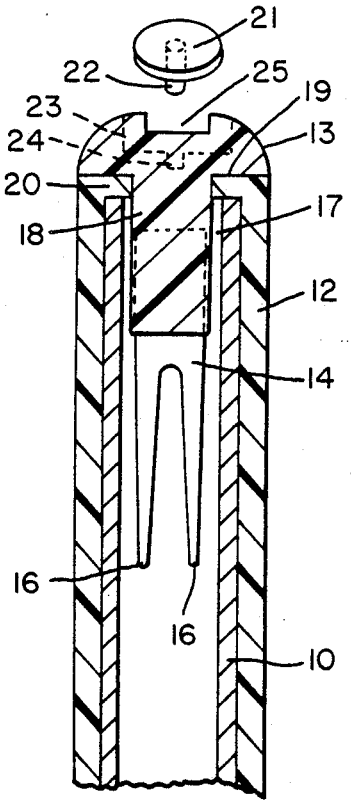
FIG. 4
FIG. 3
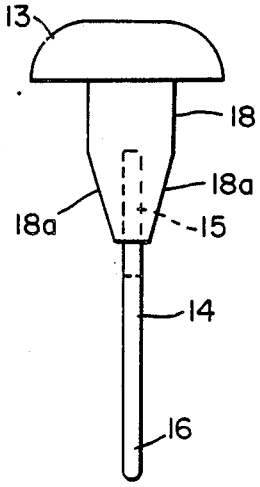
FIG. 2
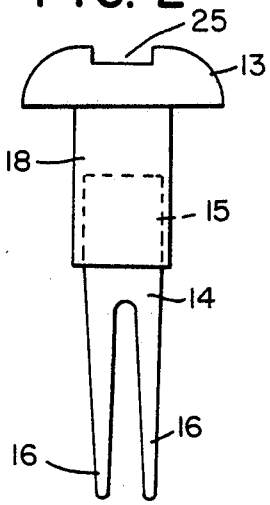

GOLF PUTTER WITH DETACHABLE DIVOT MENDER STORED IN GRIP

This application is a continuation, in part, of my copending application Ser. No. 111,864, filed Oct. 23, 1987, now U.S. Pat. No. 4,799,684.

BACKGROUND OF THE INVENTION

In the game of golf the putting green must be free as possible from surface irregularities which may be caused by balls striking the green during play. These irregularities are commonly known as divots. It is the obligation of the players to remove or mend these divots as they occur. This is frequently done by smoothing or lifting of the indented areas by means of a device which may be formed with two or more tines of prongs. Usually, this device is carried in a pocket of a golf bag or on the person of a player, and as is the case with loose devices, may be lost or forgotten so as not to be available when required. The prongs of such loose devices are cumbersome and may also damage clothing.

SUMMARY OF THE INVENTION

In accordance with applicant's invention he has designed a divot mending tool which can be inserted and retained within the grip end of a golf shaft and which consists of a tined implement mounted upon a holder, the upper portion of which forms the cap of the club over the grip. The tine carrying element is integral with or embedded within said holder which is designed and dimensioned to enter an opening formed in the cap and to frictionally engage the walls of said opening without necessarily engaging the inner wall of the shaft. This encloses the unit within the grip and permits the upper portion of the holder to cap the end of the shaft. For convenience and availability on the putting green, the device is usually incorporated in the shaft of a putter. The upper portion of the device which serves as a cap is designed to receive and retain a ball marker as described further below.

By forming an opening of a standardized size in the existing cap of the club, the body of the mender need only to conform to said opening and be formed to have a diameter very slightly larger, in order to ensure frictional engagement with the wall of the opening. Since the cap of the club is generally formed of slightly resilient material, the compression of a slightly larger diameter holder will suffice to retain it in position. Where the cap is of rigid material, the body of the mender which is preferably formed of resilient material will also exert sufficient compression to permit retention in the end of the club. This arrangement permits the use of a mender body of one dimension to fit all clubs, assuming that a uniform sized opening in the cap is provided.

This is an improvement over the design described in my above mentioned copending application in which a tapered body is provided to engage the inner wall of the shaft. Since not all shafts have the same diameter, the provision of menders with a variety of body dimensions would be required.

BRIEF DESCRIPTION OF THE INVENTION

As shown in the drawings

FIG. 1 is a view in perspective of a golf putter with the device enclosed within the shaft end.

FIG. 2 is a front view in elevation of the mending unit itself.

FIG. 3 is a side view in elevation of the mending unit.

FIG. 4 is a view in cross section showing this mending unit as it is inserted within the cap at the end of the club shaft of FIG. 1.

DETAILED DESCRIPTION

As shown in the drawings, FIG. 1 illustrates a golf putter having a shaft 10, a putting head 11 and grip 12. At the end of the grip, the divot mending device of the inventor is inserted with its upper end in the form and shape of an end cap of the grip as shown at 13.

The divot device is illustrated in greater detail in FIGS. 2 and 3 which describe a double tined flat member 14 having its upper end firmly embedded or integrally formed at 15 in a circular body 18 which is composed of rigid or semi rigid natural or synthetic rubber or plastic, the upper portion of which is shaped to enter and engage the wall 19 of an opening formed in the original cap portion 20 of the grip, as shown in FIG. 4. The body 18 is formed with a cap portion 13 designed to form or replace the original end cap of the club. Member 14 is provided with a pair of tines 16. Surrounding member 14, around its upper portion immediately beneath cap 13, is the body portion 18 which is dimensioned to slide within and releasably engage the inside wall of the opening in the original cap as described above. This sleeve can be formed of semi-rigid or slightly resilient material such as rubber or plastic or may be of metal since it can be wedged within the opening in the cap end of the grip as long as it is slightly larger than the opening. In this way, the device can be retained within the grip end of the club shaft, withdrawn for use and replaced for storage. Also, as shown at 18 in FIG. 3, the bottom portion of body 18 is formed with a pair of downwardly tapered flat surfaces in line with the edges of the tines in order to permit the fingers of the user to more firmly engage the body of the device when in use. The entire mender assembly may be also made in one piece of plastic or natural or synthetic rubber molded of rigid or semi-rigid material or may be formed of a metal strip embedded in a rubber or plastic cap and also embedded in the tapered member.

The manner in which the device is positioned in the club is illustrated in greater detail in FIG. 4 which shows shaft 10 surrounded by grip 12, the upper end of which overlies the end of the shaft and normally forming the cap portion as shown at 20. However, in order to retain the device, an opening 19 is drilled or cut centrally in the top of the cap. This opening is smaller in diameter than the inner wall of the shaft. The body of the device as shown at 18 is dimensioned to snugly engage the inner wall of said opening by frictional engagement, as shown at 19, with the result that the body of the device and its depending tines will be spaced from the wall of the shaft as shown at 17. Of course, if the hollow shaft has a diameter approximating that of the opening in the cap, the device may fit closely within the shaft with little or no space therebetween. Ordinarily the size of the opening would be selected to ensure that some space is provided. The cap portion of the device 13 may be provided a space for accommodating a ball marker 21, which is a flat disc formed with a depending prod 22. Assuming that the marker is circular, a corresponding opening or space 23 is formed in the cap portion, as shown in dotted lines, and a recess 24 is also provided to firmly engage and enclose prong 22. In order to facilitate removal of the ball marker, a transverse slot 25 is formed in cap 13, as shown also in FIG.

2. The recess is dimensioned to ensure that the marker will be positioned slightly below the outer surface of the cap s that it will be protected against damage when the club is inverted in the golf bag.

In use, the player upon reaching the green can readily remove this ever ready and ever handy device and by reaching down gently remove the divot formed by the landing of the ball by lifting and then stroking the grass turf beneath to restore the desired surface.

This device can be incorporated in an existing putter by drilling or cutting a hole of the desired diameter in the end of the grip at the shaft end or butt, and then inserting the divot mender within the grip as shown. The cap on the mender thus replaces the original cap.

I claim:

1. A golf putter including a shaft with a hollow end and having a hand grip which surrounds the upper end of the shaft, and a divot mending device positioned within such hollow end said shaft and hand grip also having a cap portion overlying the end thereof and an opening formed in said cap portion having a diameter smaller than the diameter of said shaft at the end thereof, said divot mending device having a sleeve or body portion including a tined strip depending therefrom, said body portion having a diameter corresponding substantially to that of the said opening in said cap portion but sufficient to be frictionally engaged thereby, said body portion with said tined strip being thereby positioned within the inner wall of said shaft when inserted therein, and a cap member affixed to or integral with said body portion which overlies the end of said shaft and said cap portion in which said opening has been made to form an end cap for said shaft.

2. A golf putter having a divot mending device in corporated therewith according to claim 1, wherein the cap portion of said device is provided with a recess to receive a ball marker which is in the form of a disk having a depending prong, said recess also having an opening to receive and firmly engage said prong.

* * * * *